US005379852A

United States Patent [19]

Strange, Jr.

[11] Patent Number: 5,379,852

[45] Date of Patent: Jan. 10, 1995

[54] CORE DRILL BIT

[76] Inventor: William S. Strange, Jr., P.O. Box 1298, Waskom, Tex. 75692

[21] Appl. No.: 179,083

[22] Filed: Jan. 10, 1994

[51] Int. Cl.[6] ..... E21B 10/02

[52] U.S. Cl. ..... 175/403

[58] Field of Search ..... 175/403, 418

[56] References Cited

U.S. PATENT DOCUMENTS

| | | | |
|---|---|---|---|
| 443,072 | 12/1890 | Chapman | 175/403 |
| 1,163,867 | 12/1915 | Shaffer | 175/403 |
| 1,172,139 | 2/1916 | Jenkins | 175/403 |
| 1,193,468 | 8/1916 | Okell | 175/403 |
| 2,312,176 | 1/1941 | Kotowski | 175/403 |

*Primary Examiner*—Ramon S. Britts

*Assistant Examiner*—Frank S. Tsay

*Attorney, Agent, or Firm*—John M. Harrison

[57] ABSTRACT

A core drill bit having a nozzle screen and designed for drilling into an underground formation and obtaining samples of the formation. As the bit cuts through the formation, a core of the formation material is forced upwardly through the drill bit into the attached core barrel and drilling fluid is pumped from the surface, through the core barrel and the screen mounted in the body of the bit and subsequently, through jet nozzle orifices radially arranged in the crown of the bit. The screen prevents oversized formation fragments, gravel and debris from lodging in the jet nozzles and obstructing the nozzle orifices and thus facilitates unobstructed flow of drilling fluid through the jet nozzles.

18 Claims, 2 Drawing Sheets

CORE DRILL BIT

BACKGROUND OF THE INVENTION

1. Field of the Invention

This invention relates to core drill bits and more particularly, to a core drill bit which includes multiple drilling fluid jets circumferentially spaced on the contact end, face or crown of the bit and an annular screen mounted in the drill bit body adjacent to the mouth of the jets. As the bit cuts into a subterranean interval or formation, the core of the formation is forced upwardly through the center of the bit into the core barrel attached to the bit. Drilling fluid is also pumped from a mud tank on the ground surface through the drill string and core barrel and into the bit, through an annulus surrounding the core of the formation. As it is pumped from the core barrel and bit into the drilling fluid jets, the drilling fluid passes through the screen into an annular equilization channel, which screen blocks oversized formation and circulating "mud" fragments, gravel and particulate matter large enough to plug the jet nozzles, The screened drilling fluid then flows through the jets and jet nozzles, impinges on the formation and is pumped around the core barrel and drill string up to the ground level, where it is filtered in the mud tank and redirected into the drill string and core drill bit.

2. Description of the Prior Art

Conventional drill bits are typically characterized by multiple cutting blades or elements circumferentially mounted on the contact end, face or crown of the drill bit. Drilling fluid jet nozzle are typically interposed between the cutting elements to aid the interval cutting action. The cylindrical drill bit body is provided with interior threads which are engaged by threads provided on the exterior circumference of a hollow drill pipe and as the drill pipe is rotated with the drill string, the drill bit cuts through the down-hole interval or formation. In a typical drilling application, drilling "mud" or fluid is pumped from a mud tank on the ground surface, down the drill string bore and into the drill bit and is ejected from the jet nozzles, thus assisting the cutting elements in cutting through the formation. The drilling fluid carries the dislodged formation particles to the surface, where the drilling fluid is filtered in the mud tank and the cycle repeats. In a second drilling application, a core drill bit having a hollow core is used to collect core samples. As the core drill bit cuts into the formation, a cylindrical core of dislodged formation material is pushed upwardly through the core of the drill bit and into the connecting core barrel. Drilling fluid is pumped from the mud tank down through the drill string and core barrel, into the drill bit through an annulus which surrounds the isolated formation core. When the drilling fluid reaches the drill bit, it enters several circumferentially-spaced drilling fluid jets provided on the end or crown of the drill bit and is ejected at high pressure from the jet nozzles terminating the end of the drilling fluid jet. The drilling fluid assists the cutting elements in dislodging formation material and carries loose formation particles and formation cuttings to the mud tank or pit on the surface. At the proper time, the core barrel and core drill bit are removed from the well with the drill string and the formation material collected in the core barrel is removed for analysis.

One of the problems encountered in using conventional core drill bits for obtaining formation samples as described above, is realized when the drilling fluid is pumped down the annulus under high pressure and carries or entrains formation particles or gravel of various size from the core of dislodged formation material collected in the core barrel. The drilling fluid carries these particles into the drilling fluid jets and some of the particles are large enough to block the jet nozzles so that drilling fluid cannot be ejected through the nozzles at peak efficiency. This event greatly reduces the drilling efficiency of the core bit and the drilling operation. Bag-type screens are typically installed in the drill string to reduce the incidence of jet nozzle plugging by screening the circulating well fluid, but these devices are inoperable to screen particles entrained in the well fluid from the formation core.

The core barrel drill bit of this invention includes an annular screen mounted in the drill bit body, and drilling fluid which is pumped down the annulus in the core barrel passes through the screen openings before entering the drilling fluid jets. The screen openings are sufficiently small that drilling fluid and formation particles dislodged from the core barrel and large enough to block the jet nozzles are prevented from entering the drilling fluid jets and thus cannot block the jet nozzles.

Accordingly, it is an object of this invention to provide a new and improved core drill bit which includes screened drilling fluid jet nozzles.

Another object of this invention is to provide a core drill bit which includes a woven wire or perforated plate screen mounted in the body of the bit to prevent formation gravel and other particles in the circulating fluid from entering and blocking the drilling fluid jet outlets in the drilling face or crown of the bit.

Still another object of the invention is to provide a new and improved core barrel drill bit which is characterized by multiple cutting elements circumferentially spaced on the drilling face or crown of the bit, multiple drilling fluid jets interposed between or in the cutting elements and an annular equilization channel fitted with a screen mounted in the body of the bit adjacent to the jets, to prevent formation, circulating "mud" and other particles from entering and blocking the jet nozzle orifices of the drilling fluid jets.

SUMMARY OF THE INVENTION

These and other objects of the invention are provided in a new and improved hollow core drill bit which is characterized by multiple cutting elements circumferentially mounted in spaced relationship with respect to one another on the cutting end, face or crown of the drill bit, multiple drilling fluid jets radially interposed in or between the cutting elements, an annular equilization channel provided in the bit body and communicating with the jets and an annular screen or perforated ring mounted in the core of the bit adjacent to the equilization channel, for preventing formation and other particles, gravel and debris contained in the circulating "mud" or fluid from entering and blocking the nozzle orifices of the drilling fluid jets.

BRIEF DESCRIPTION OF THE DRAWING

The invention will be better understood by reference to the accompanying drawings, wherein.

DESCRIPTION OF THE PREFERRED EMBODIMENTS

Figure 1:
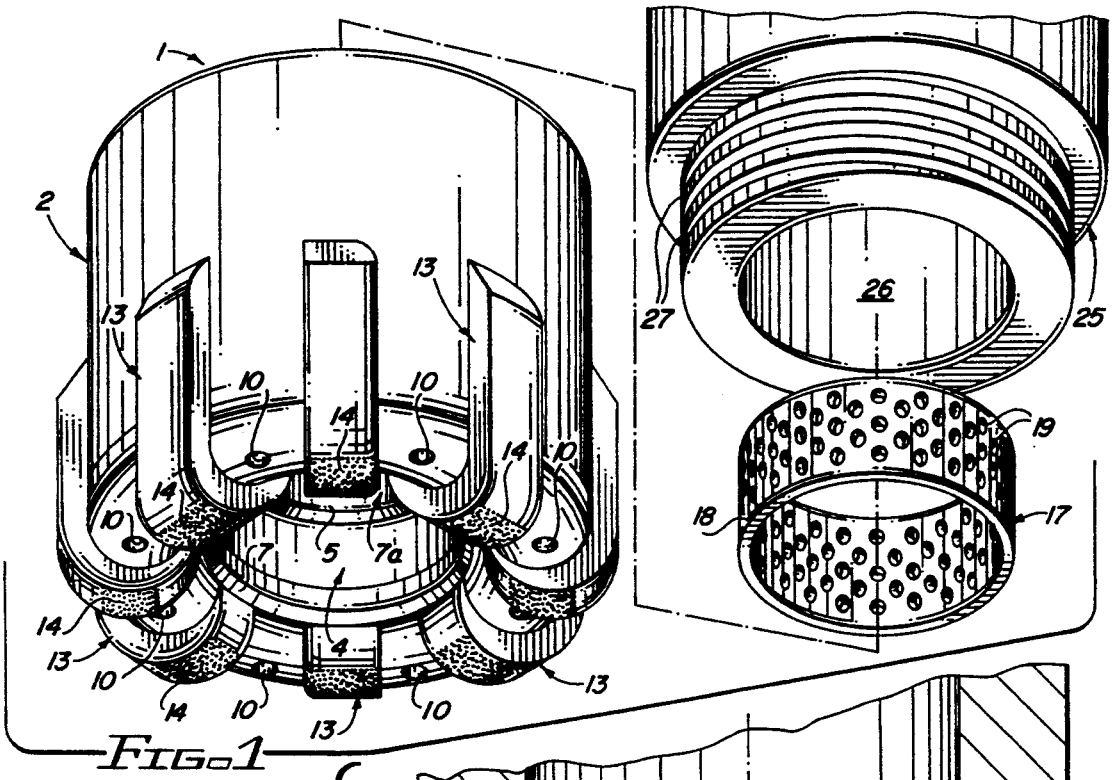
FIG. 1 is an exploded view of the core drill bit of this invention, complete with jet nozzle screen and attached to a conventional core barrel.
Figure 2:
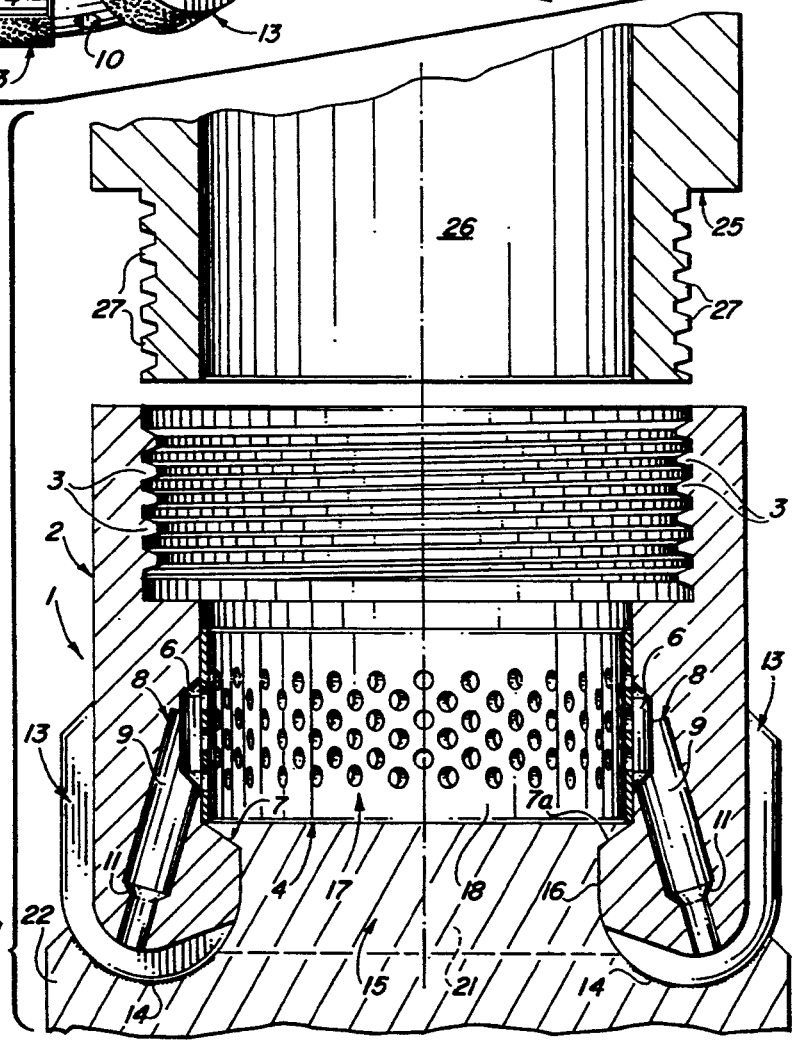
FIG. 2 is a sectional view of the core drill bit and the bottom portion of the core barrel illustrated in FIG. 1.
Figure 3:
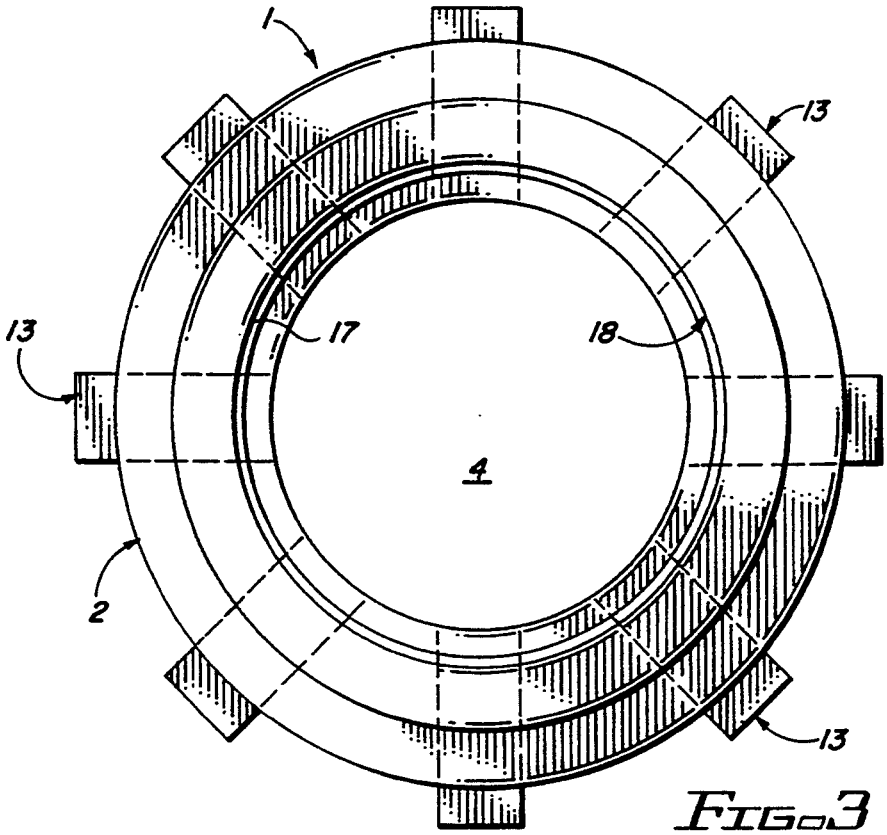
FIG. 3 is a top view of the core drill bit illustrated in FIG. 1.
Figure 4:
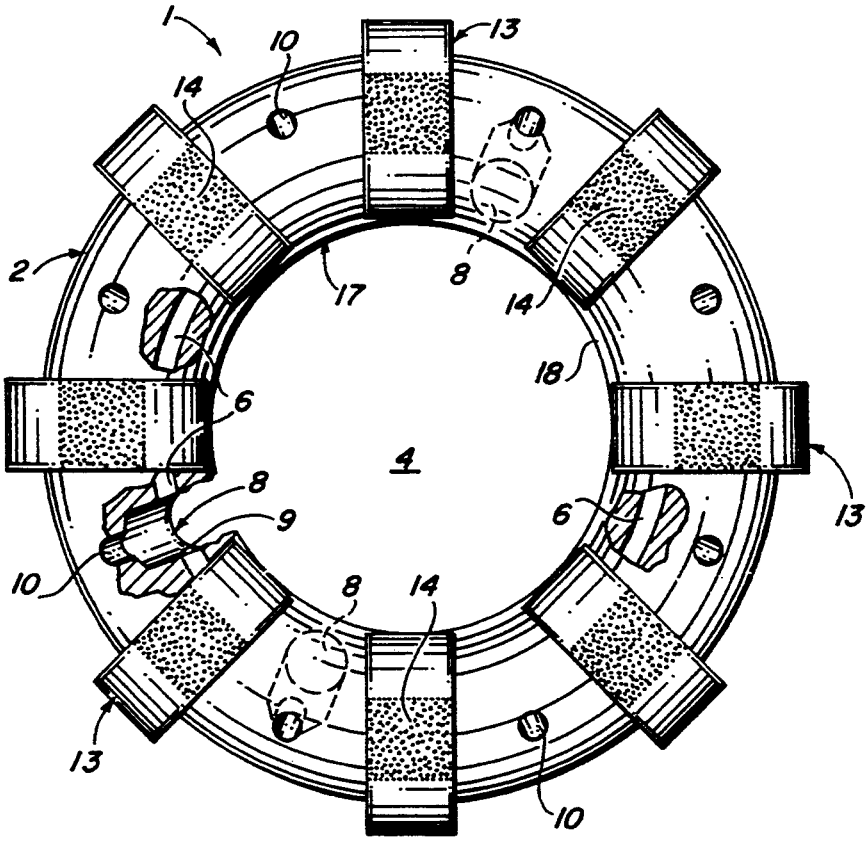
FIG. 4 is a bottom view, partially in section, of the core drill bit illustrated in FIGS. 1–3.

Referring to the drawings, the core drill bit of this invention is generally illustrated by reference numeral 1 and includes a cylindrical bit body 2, provided with internal core bit threads 3 on one end and fitted with a bit bore 4, extending longitudinally through the center thereof to define a bit bore wall 5. An annular equalization channel 6 is shaped in the bit bore wall 5 and communicates with multiple jet nozzles 8, radially arranged in the opposite end of the bit body 2 from the core bit threads 3, between spaced cutters 13. The cutters 13 are typically provided with cutting elements 14, such as industrial-grade diamond, carbide or the like. The jet nozzles 8 are each characterized by a nozzle bore 9 which communicates with the equalization channel 6 and a Connecting nozzle orifice 10, which is smaller in diameter than the nozzle bore 9 and extends from a nozzle neck 11 in each of the nozzle bores 9 of the jet nozzles 8, to the crown of the bit body 2, as illustrated in FIGS. 1 and 2. A cutting bore 15 is defined by the cutter walls 16 of the cutters 13 and communicates with the bit bore 4 of the core bit 1 at an annulus shoulder 7, as further illustrated in FIG. 2. The difference between the diameter of the bit bore 4 and the cutting bore 15 at the cutter wails 16 defines an annulus *7a*, as illustrated in FIG. 2, to facilitate flow of drilling fluid or "mud" (not illustrated) between a core element 21, illustrated in phantom in FIG. 2, which is cut from a formation 22, and an annular screen 17, when the core bit 1 is rotated in drilling configuration, as hereinafter described. The core bit 1 is threadibly connected to a core barrel 25 in conventional fashion by means of core barrel threads 27 and the cooperating core bit threads 3, as further illustrated in FIGS. 1 and 2.

The circular or annular screen 17 is seated in the bit bore wall 5 of the bit bore 4, adjacent to the equalization channel 6 and includes an annular screen ring 18, provided with ring or screen openings 19 which are smaller in diameter than the nozzle orifices 10 of the jet nozzles 8. Accordingly, it will be appreciated that the screen IV serves to prevent particles washed from the core element 21 and entrained in the drilling "mud" from entering the nozzle bore 9 and nozzle orifice 10 of each of the jet nozzles 8 and thus plugging the nozzle orifices 10 and preventing optimum jetting action from the stream of drilling "mud" (not illustrated) pumped through the annulus *7a*.

In operation, and referring again to FIGS. 1 and 2 of the drawings, the core bit 1 is caused to rotate by rotating the core barrel 25 and a drill string (not illustrated) attached to the core barrel 25, in conventional fashion. Drilling "mud" is pumped through the drilling string, the drilling string core barrel 25 and the bit bore 4, where it is forced through the ring or screen openings 19 of the screen 17, into the equalization channel 6 and finally, through the jet nozzles 8. Expulsion of the drilling "mud" through the respective nozzle orifices 10 of the jet nozzles 8 at high pressure creates a jetting or cutting action that aids in cutting the formation 22 by the cutters 13 as the core bit 1 rotates. Simultaneously with rotation of the core bit 1, a cylindrical core element 21 is cut from the formation 22 and forced through the bit bore 4 at the diameter of the cutting bore 15, thus creating the annulus *7a*, through which the drilling "mud" then flows. The drilling "mud" continues from the nozzle orifices 10 and the cutting elements 14 at the cutters 13, around the crown of the core bit 1 and the core barrel 25 and along the drill string back to the surface, where it is filtered and recycled again through the drilling string core barrel and core bit 1, as above described. Since the drilling "mud" must flow through the ring or screen openings 19 in the screen ring 18 of the screen 17, those entrained particles which would normally flow through the jet nozzles 8 and are slightly oversized with respect to the nozzle orifices 10, are prevented from traveling through the ring or screen openings 19, thus preventing plugging of the nozzle orifices 10 and reducing the drilling efficiency of the core bit 1. The equalization channel 6 is provided in the bit bore wall 5 to prevent aggregation or accumulation of particles which are small enough to pass through the ring or screen openings 19 and might otherwise collect to jam the nozzle bores 9 of the respective jet nozzles 8.

It will be appreciated by those skilled in the art that the size of the ring or screen openings 19 in the screen ring 18 of the screen 17 can be chosen to facilitate passage of particles from the core element 21 and the recirculated drilling "mud" which are sufficiently small to easily clear the respective nozzle bores 9 and nozzle orifices 10 of the jet nozzles 8 and promote a cutting or jetting action against the formation 22 at the point of contact between the cutters 13 and the cutting elements 14 with the formation 22. Furthermore, the number and shape of ring or screen openings 19 can be chosen so as not to unduly reduce the pressure of the flowing drilling "mud" or fluid and facilitate smooth stream of drilling "mud" or fluid through the core bit 1, back to the surface. Moreover, the material and method of construction of the screen 17 can be chosen commensurate with the wear factor desired. However, the screen 17 is typically constructed of annular perforated stainless steel plate or woven wire screen or a similar wear and corrosion-resistant metal, according to the desires of the user. The size, shape and depth of the equalization channel 6 may also be chosen commensurate with the size of the screen 17 and ring or screen openings 19, to effect a swirling action of the drilling fluid or "mud" prior to entry of the drilling mud in the jet nozzles 8 for breaking up any accumulation or collection of particles which are sufficiently small to pass through the ring or screen openings 19 of the screen ring 18.

It will be further appreciated by those skilled in the art that the screen 17 can be installed or retrofitted in many core bits of conventional design to greatly enhance the cutting efficiency of the bit. Accordingly, the core bits may be characterized by a parabolic crown, medium tapered crown, rounded flat crown or round crown profile, or the like, and may have a cutter and jet nozzle design suitable for coring a selected interval or formation. In a most preferred embodiment, regardless of the core bit design, an equalization channel 6 is cut into the bit body 2 of the core bit 1 and the screen 17 is positioned adjacent to the equalization channel 6 to facilitate the purposes described above in an optimum manner.

While the preferred embodiments of the invention have been described above, it will be recognized and understood that various modifications may be made without departing from the spirit and scope of the invention.

Accordingly, what is claimed is:

1. A core drill bit for drilling through a subterranean formation and capturing a core of the formation using drilling fluid, comprising a core bit; at least one nozzle means provided in said core bit for directing the drilling fluid against the formation; and screen means provided in said core bit between said nozzle means and the core for screening said nozzle means from particles in the drilling fluid.

2. The core drill bit of claim 1 comprising equilization channel means provided in said core bit between said screen means and said nozzle means, for dispersing the core particles flowing through said screen means into said nozzle means.

3. The core drill bit of claim 1 wherein said at least one nozzle means comprises a plurality of jet nozzles spaced in said core bit.

4. The core drill bit of claim 1 wherein said at least one nozzle means comprises a plurality of jet nozzles spaced in said core bit and comprising equilization channel means provided in said core bit between said screen means and said jet nozzles, for dispersing the core particles flowing through said screen means into said jet nozzles.

5. The core drill bit of claim 3 wherein said jet nozzles each further comprises a nozzle bore facing said screen means and a nozzle orifice having a diameter smaller than said nozzle bore and communicating with said nozzle bore.

6. The core drill bit of claim 5 comprising equilization channel means provided in said core bit between said screen means and said jet nozzles, for dispersing the core particles flowing through said screen means and said jet nozzles.

7. A core drill bit for drilling through a subterranean formation and capturing a core of the formation using a drilling fluid pumped between the core and the bit, said core drill bit comprising a bit having a bit bore for receiving the core and bit cutters provided on said bit for cutting the core from the formation; a plurality of jet nozzles extending through said bit from said bit bore in substantially radially spaced relationship with respect to each other, for directing the drilling fluid against the formation; and screen means provided in said bit between to said jet nozzles and said bit bore for screening said jet nozzles from particles in the drilling fluid.

8. The core drill bit of claim 7 comprising an equilization channel provided in said core bit between said screen means and said jet nozzles, for dispersing the core particles flowing through said screen means and into said jet nozzles.

9. The core drill bit of claim 7 wherein said jet nozzles each further comprises a nozzle bore facing said screen means and a nozzle orifice having a diameter smaller than said nozzle bore and communicating with said nozzle bore.

10. The core drill bit of claim 7 comprising an equilization channel provided in said core bit between said screen means and said jet nozzles, for dispersing the core particles flowing through said screen means and said jet nozzles and wherein said jet nozzles each further comprise a nozzle bore facing said screen means and a nozzle orifice having a diameter smaller than said nozzle bore and communicating with said nozzle bore.

11. A core drill bit for mounting on a core barrel and drilling through a subterranean formation and capturing a core of the formation using drilling fluid pumped through the core barrel and core drill bit, said core drill bit comprising a core bit having a plurality of cutting elements and a longitudinal bore; a plurality of nozzle means provided in said core bit and communicating with said bore and said cutting elements for directing the drilling fluid from the bore against the formation; and screen means provided in said core bit between said nozzle means and said bore, for screening said nozzle means from particles entrained in the drilling fluid.

12. The core drill bit of claim 11 comprising equilization channel means provided in said core bit between said screen means and said nozzle means, for dispersing the core particles flowing through said screen means into said nozzle means.

13. The core drill bit of claim 11 wherein said nozzle means comprises a plurality of jet nozzles radially spaced in said core bit.

14. The core drill bit of claim 11 wherein said nozzle means comprises a plurality of jet nozzles radially spaced in said core bit and comprising equilization channel means provided in said core bit between said screen means and said jet nozzles, for dispersing the core particles flowing thorough said screen means into said jet nozzles.

15. The core drill bit of claim 11 wherein said screen means comprises a perforated annular plate.

16. The core drill bit of claim 15 wherein said nozzle means comprises a plurality of jet nozzles radially spaced in said core bit and comprising equilization channel means provided in said core bit between said perforated annular plate and said jet nozzles, for dispersing the core particles flowing through said perforated annular plate into said jet nozzles.

17. The core drill bit of claim 11 wherein said screen means comprises a woven metal strand screen.

18. The core drill bit of claim 17 wherein said nozzle means comprises a plurality of jet nozzles radially spaced in said core bit and comprising equilization channel means provided in said core bit between said woven metal strand screen and said jet nozzles, for dispersing the core particles flowing through said woven metal strand screen into said jet nozzles.

* * * * *